United States Patent [19]

Moyse

[11] 4,020,766

[45] May 3, 1977

[54] EXPLOSIVE PROJECTILE

[75] Inventor: Bernard Moyse, Chene-Bourg, Switzerland

[73] Assignee: Sarmac S.A., Geneva, Switzerland

[22] Filed: Nov. 20, 1974

[21] Appl. No.: 525,662

[52] U.S. Cl. ..... 102/80; 102/78; 102/79

[51] Int. Cl.[2] ..... F42C 15/26

[58] Field of Search ..... 102/80, 78, 79, 70 R, 102/76 P

[56] References Cited

UNITED STATES PATENTS

| | | | |
|---|---|---|---|
| 1,205,921 | 11/1916 | Moren | 102/78 |
| 1,424,112 | 7/1922 | Malby | 102/78 |
| 1,440,191 | 12/1922 | Wennerström | 102/80 |
| 1,455,741 | 5/1923 | Wennerström | 102/78 |
| 1,687,341 | 10/1928 | Lukens et al. | 102/78 |
| 2,777,392 | 1/1957 | Laakso | 102/80 |

*Primary Examiner*—David H. Brown
*Attorney, Agent, or Firm*—Young & Thompson

[57] ABSTRACT

The invention relates to an explosive projectile comprising an explosive charge and a device for firing a detonator outside of the charge, characterized in that the explosive charge comprises a recess, in that the projectile comprises a device for priming this explosive charge comprising an explosive relay housed at all times at least partially in the recess in the explosive charge and mounted to slide therein between a retracted safety position in the explosive charge for which the relay is kept remote from the detonator and a forward armed position in which this relay is situated in the immediate proximity of the detonator or is in contact therewith, while being partially engaged in the explosive mass, and in that it also comprises a device for locking the explosive relay in its retracted safety position.

41 Claims, 18 Drawing Figures

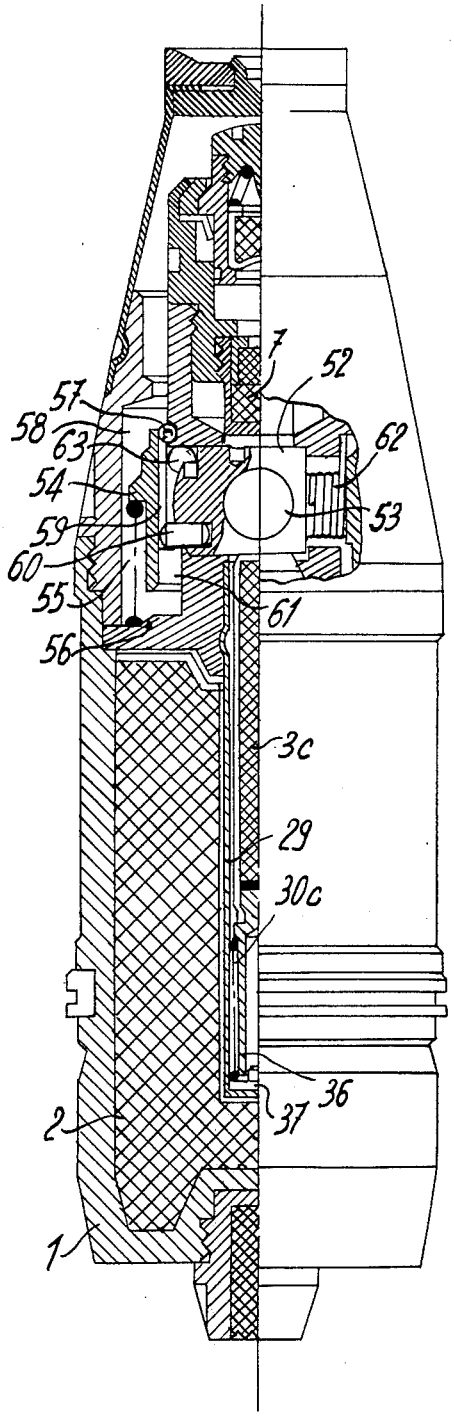
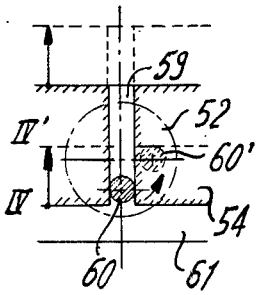
FIG. 4'
FIG. 4

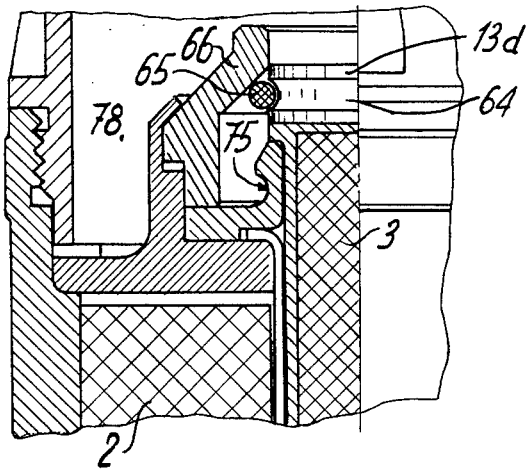
FIG. 5
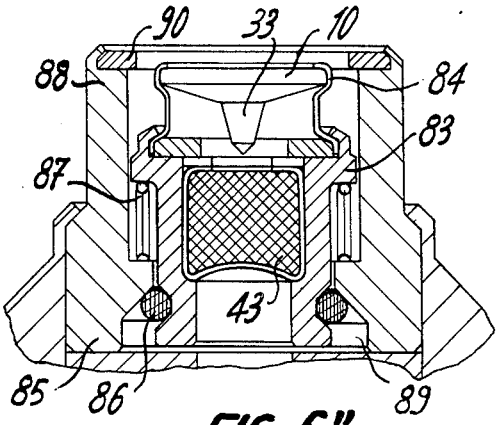
FIG. 6"

EXPLOSIVE PROJECTILE

This invention relates to an explosive projectile with a detonator apart from the charge and having a particularly simple priming device.

Therefore, the object of the present invention is an explosive projectile comprising an explosive charge and a device for igniting a detonator which is outside of the charge, characterised in that the explosive charge comprises a cavity, and in that the projectile comprises a device for priming this explosive charge comprising an explosive relay housed at all times at least partially in the recess in the explosive charge and mounted to slide therein between a retracted safety position in the explosive composition for which the relay is separated from the detonator, and an advanced armed position in which this relay is situated in immediate proximity of the detonator or in contact therewith, while still being partially engaged in the explosive composition, and in that it further comprises a device for locking the explosive relay in its retracted safety position.

The essential and new principle of the priming device resides in the fact that a fraction of the explosive charge, here referred to as the explosive relay, comprising no sensitive material, is designed to be brought, after commencement of firing and releasing, into proximity of or into contact with the detonator, the relay still being partially within the explosive charge. In the non-armed retracted position, the explosive relay is locked within the explosive charge; moreover, the locking means may serve as an occluding means, mechanically separating the relay from the detonator and moving aside once the firing action has started, to free the relay which, under the action of a spring and the effect of deceleration of the projectile, moves into the armed position described hereinabove.

The distance between the relay and the detonator is such that in the event of accidental explosion of this latter, it prevents explosion of the relay and thus of the associated explosive charge. This arrangement provides quite considerable safety in the event of the projectile being dropped or crushed.

The safety of the projectile in use is further increased by virtue of the fact of the occluding means serving at the same time as a means of locking the relay in the retracted position and as a means of shutting off or providing a physical barrier for this latter, protecting it against inopportune operation of the detonator (thus limiting the consequences to this accident alone).

According to one form of embodiment, the unlocking of the retention means in order to free the occluding means and thus the relay can be effected only under the influence of centrifugal force due to the rotation of the projectile during its trajectory and/or the violent acceleration undergone as the shot is fired. Therefore, the priming device can only be armed after the shot has been fired, so ensuring additional safety, referred to as "muzzle safety".

Likewise, certain forms of embodiment of the percussion device are provided so that this latter may be armed only after the shot has been fired, likewise under the effect of centrifugal force or considerable acceleration; therefore, in this case, the percussion device may not be armed under the effect of a slow accidental crushing (handling safety); furthermore, the percussion itself may not occur under the effect of impact of the projectile launched against an obstacle.

However, this invention may likewise be applied to other forms of projectiles, namely to explosive grenades, either be they hand grenades, grenades with handle, mortar shells, etc.

These conditions of operation prohibit any premature priming of the explosive charge as the result of an accident in handling such as a shock, dropping, crushing, etc., their dynamic effect being considerably less than that imparted by the firing of a shot indispensable to the carrying of the pyrotechnic chain into effect.

This invention is more particularly applied to a projectile with an instantly functioning percussive nose fuse operated by compression on impact. The whole of the fuse constituted by the nose fuse and the priming relay generally takes the form of an axial pyrotechnic chain of concentric elements, the main qualities of which are lightness, ruggedness and easy fitment. This fuse has at its forward end a flat head carried by a deformable cap or false nose ensuring operation under high impact.

In still further forms of embodiment, the retention means for liberating the occluding means and thus the relay may be unlocked manually from outside the projectile.

The attached drawings show by way of example a form of embodiment of the explosive projectile according to the invention together with a plurality of alternative forms and details thereof.

FIGS. 2 to 6 show sectional or partially sectional views of five forms of embodiment of the projectile and of its fuse;

Figure 2:
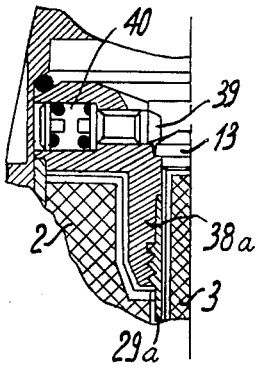
Figure 2:
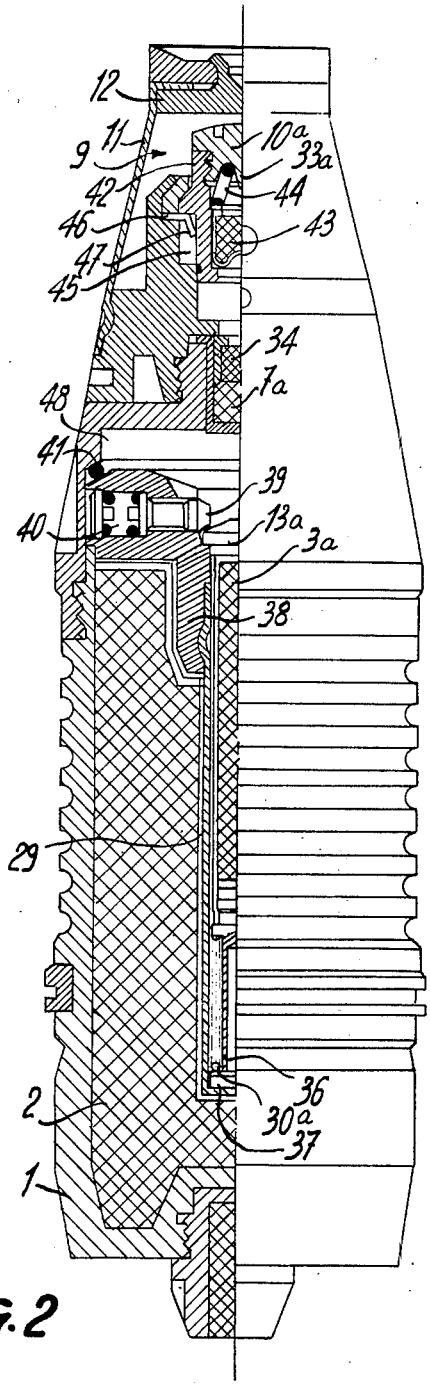
Figure 3:
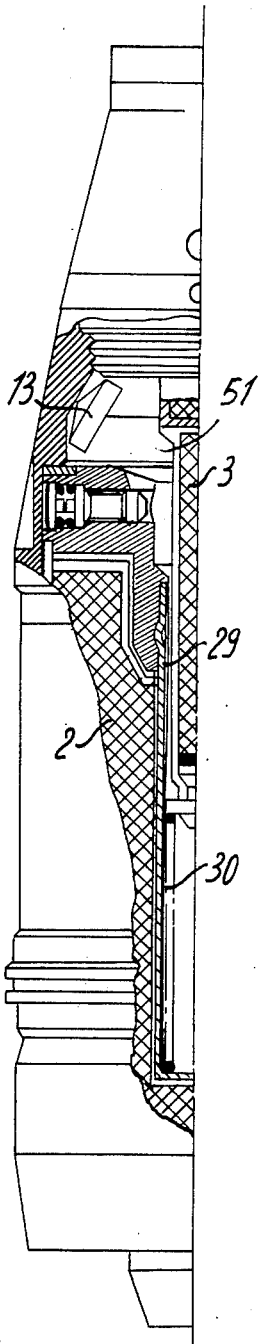
Figure 3:
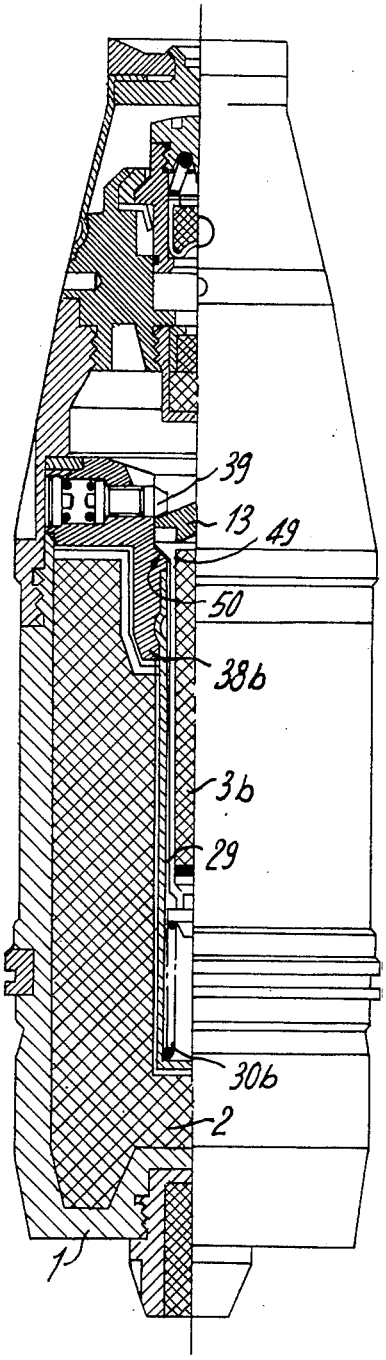
Figure 6:
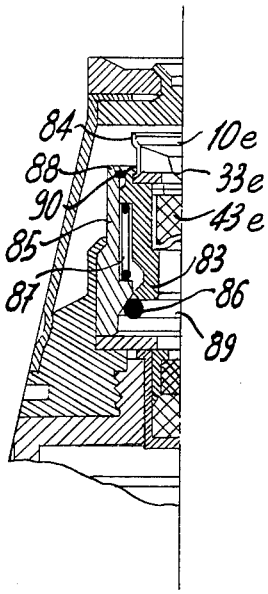
Figure 6:
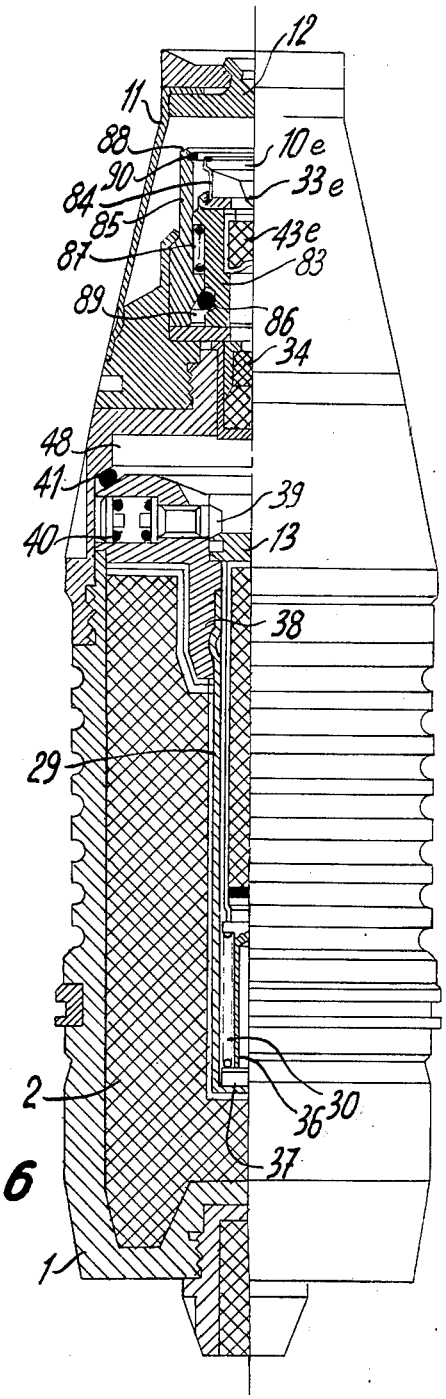
Figure 7:
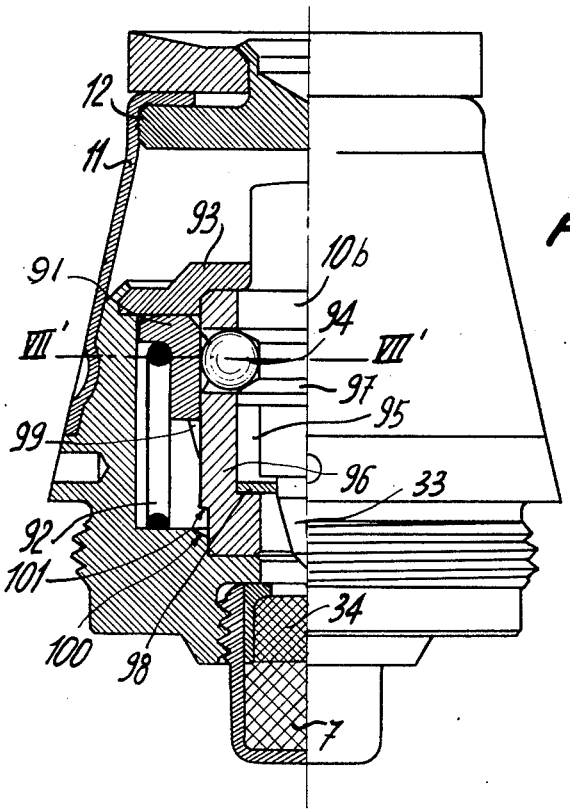
Figure 7:
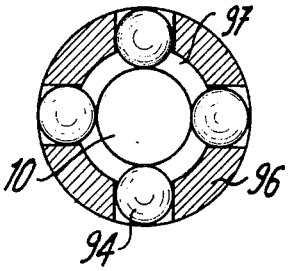
Figure 8:
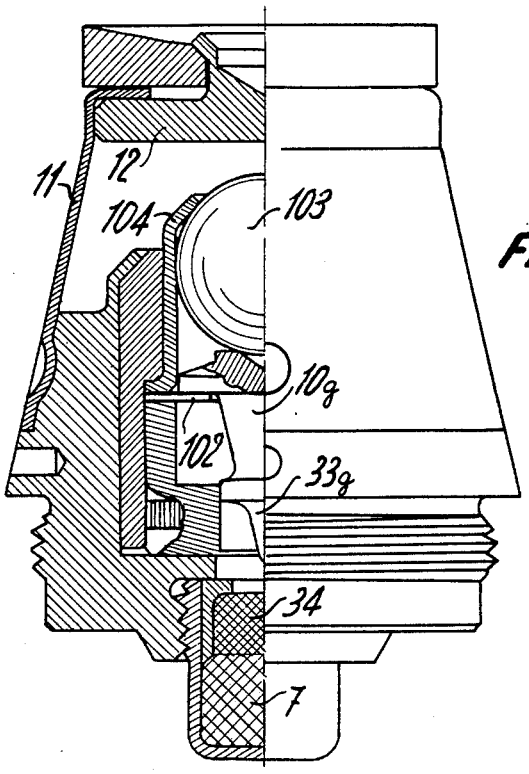
Figure 9:
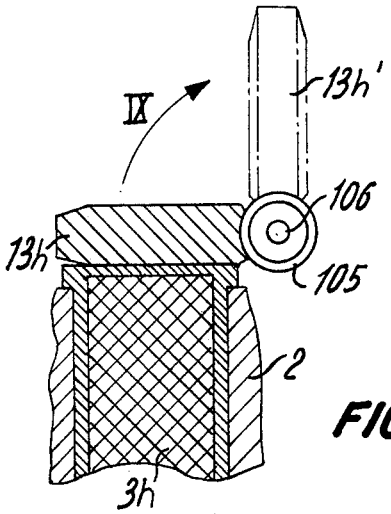
Figure 10:
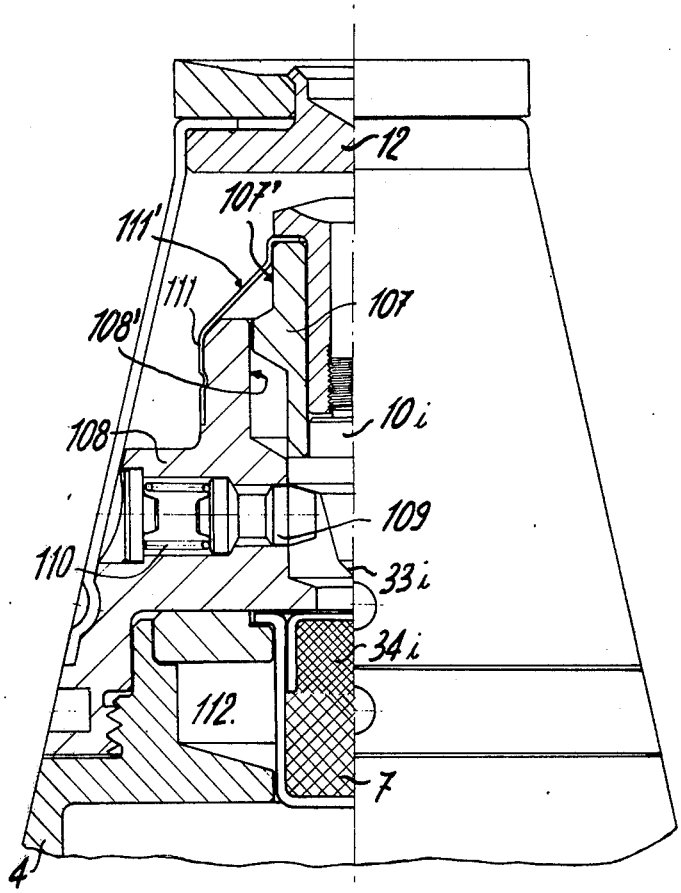
Figure 11:
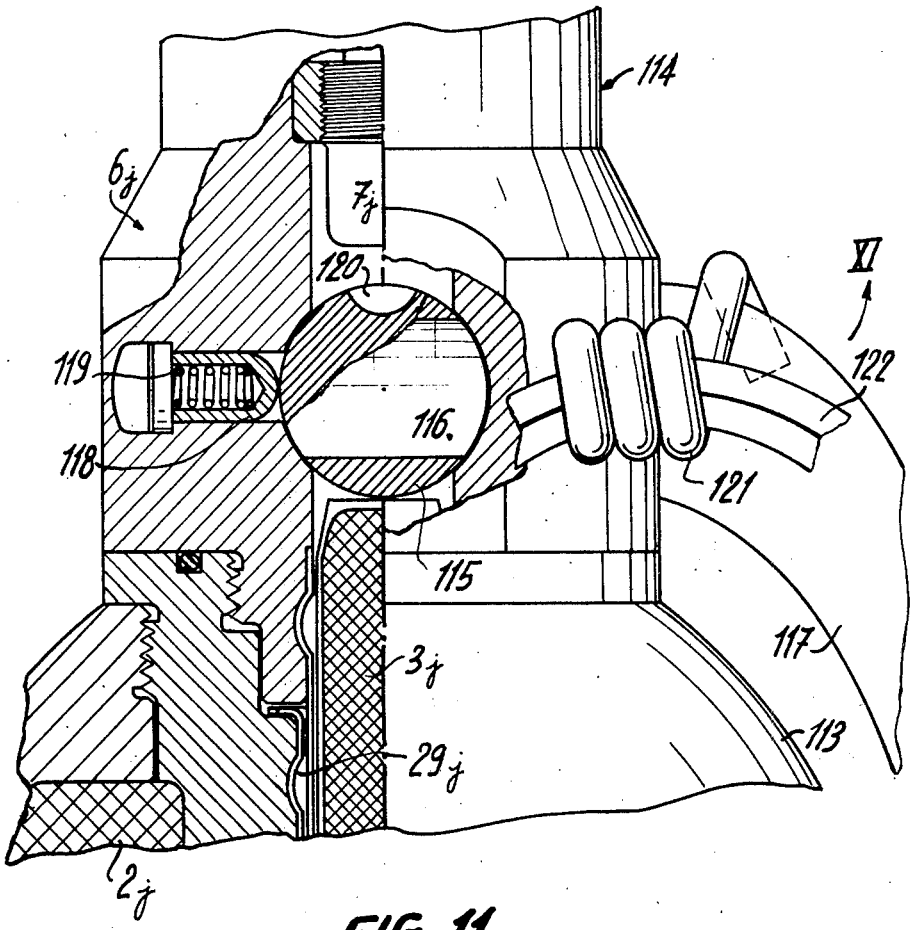
Figure 12:
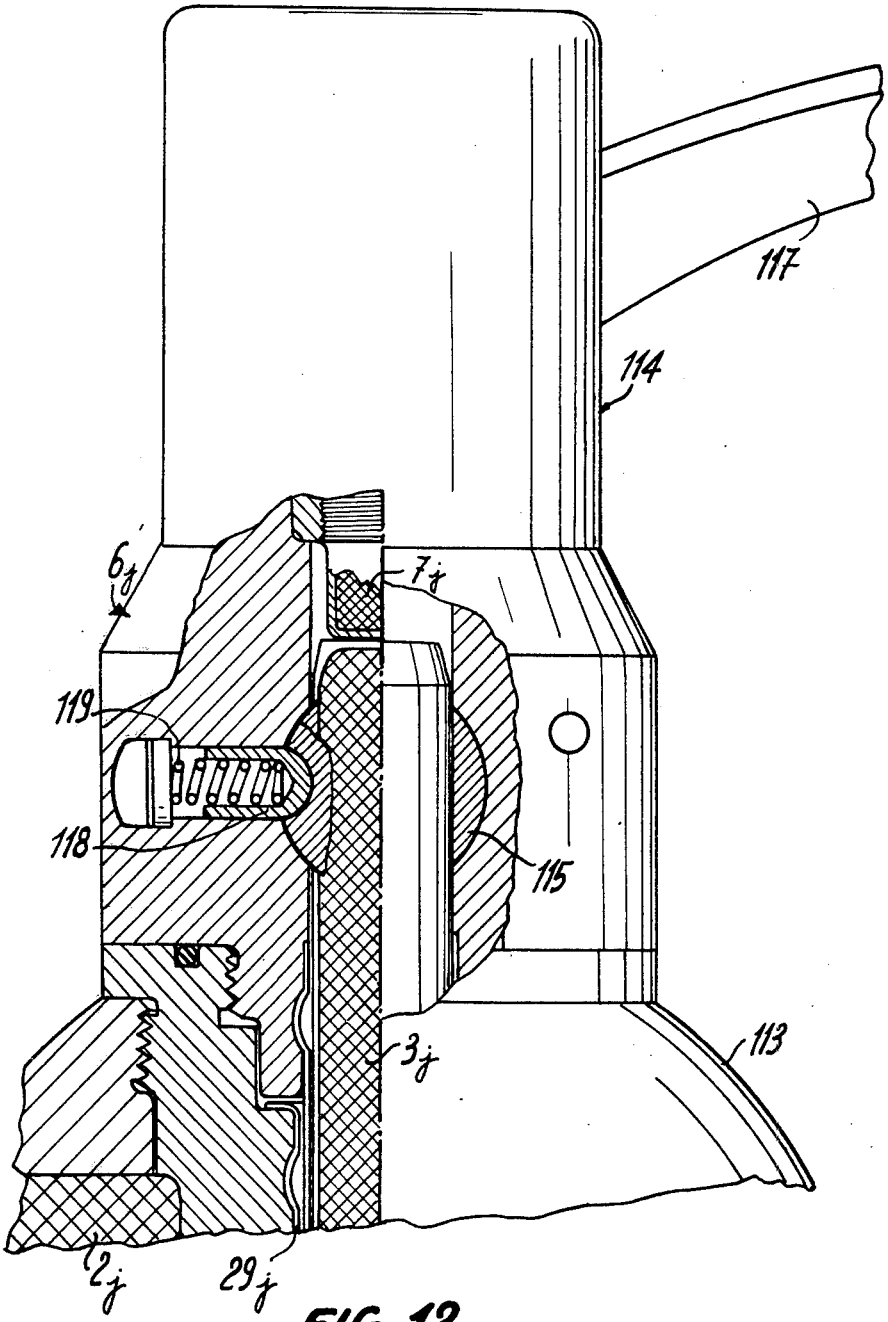

FIG. 2' shows a detail of an alternative embodiment of FIG. 2;

FIG. 3' is a view showing the projectile locking device of FIG. 3, which locks it in the armed position;

FIG. 4' is a view showing a detail of FIG. 4;

FIG. 6' is a view showing the percussion device of FIG. 6, in its armed position;

FIG. 6'' is a view showing the detail of the percussion device in the alternative embodiment shown in FIG. 6;

FIGS. 7, 8 and 10 show partially sectional views of three forms of embodiment of the percussion device of the projectile according to the invention;

FIG. 7' is a view showing the section at right-angles to the axis of the projectile according to the line VII—VII in FIG. 7;

FIG. 9 is a diagrammatic sectional view of an alternative embodiment of locking device;

FIG. 11 is a partially sectional view of a form of embodiment of locking device for a hand grenade, in the non-armed position FIG. 12 is a partially sectional view of the alternative embodiment in FIG. 11 in the armed position.

Figure 1:
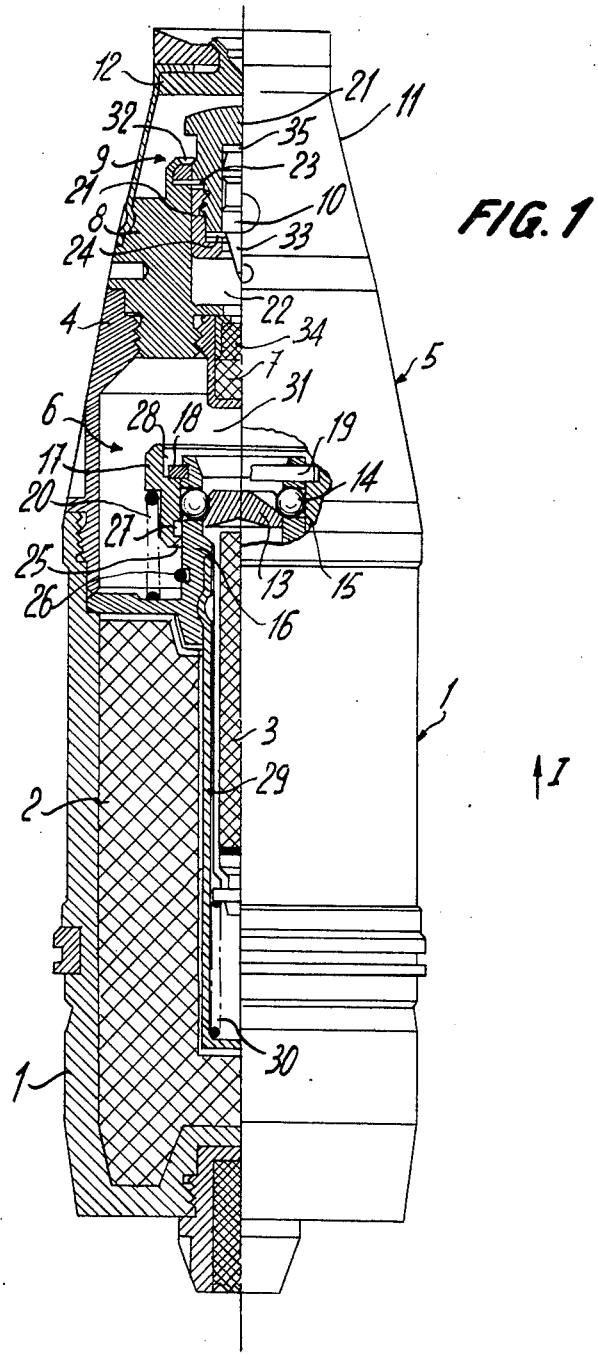
FIG. 1 shows a partially sectional view of a projectile and its fuse according to the invention.

The fuse assembly shown in FIG. 1 and intended to be fixed on a projectile, comprising a cylindrical body 1 of steel or cast iron, containing the explosive mass 2, the explosive mass 2 comprising an axial cylindrical recess to house an explosive relay 3 which in fact constitutes a part of this explosive mass. Screwed onto the upper part of the cylindrical body 1 of the projectile is a body 4 of the head 5 enclosing the device 6 for locking the relay 3. A body 8 is screwed onto the body 4 of this head and is provided axially with a fixed detonator 7, and a percussion device 9 comprising a plunger 10. The upper part of the fuse comprises a deformable cap 11 or false nose intended to be crushed upon impact of the projectile in order to operate the plunger 10 through a plate 12.

The device 6 for locking the explosive relay 3 comprises an occluding means 13 locked by two balls 14 maintained in housing 15 in a central part 16 on which there is a slidable ring 17 which is maintained in abutment against a clip 18 disposed in an annular groove 19 in the upper end of the central part 16, by the action of a spring 20.

The percussion device 9 comprises a body 21 of two parts mounted to slide within the chamber 22 formed in the centre of the body 8 and maintained abutting against a mat 23 in the position as shown in FIG. 1. The plunger 10 is mounted to slide in the body 21 and is maintained likewise in abutment against a mat 24.

When the shot is fired, by virtue of the inertia due to acceleration, the ring 17 slides on the central part 16, compressing the spring 20. At the end of its stroke, the chamber 25 causes the elastic ring 26 to enter and become locked in its housing, this ring 26 expanding then in the annular chamber 27 of the ring 17, in order to hold the ring 17 in the retracted position. Under the effect of centrifugal force, the balls 14 then being no longer retained, emerge partially from their housings 15, their eccentric displacement being limited by the lateral walls of the annular chamber 28, but sufficing to produce releasing of the plate or occluding means 13.

At emergence from the barrel, since acceleration is no longer felt, the occluding means 13 is pushed towards the front of the projectile (arrow I) on the one hand under the action of the inertia due to deceleration and on the other by the explosive relay 3, disposed inside a sheath 29, itself pushed by the action of a spring 30 which it compresses in its retracted position such as is illustrated in FIG. 1. The fixed sheath 29 is crimped with the central part 16 within the recess provided in the explosive charge 2.

When the occluding means 13 is at least partially out of its housing, its balance is upset by its unbalanced mass and it is ejected laterally under the effect of centrifugal force in the chamber 31, so that it can flatten itself against the lateral wall of this latter; the passage is thus freed, allowing the relay 3 to move forwards (arrow I) until it comes in contact with the detonator 7, into an armed and advanced position. In this form of embodiment, the detonator 7 projects on the inside of the chamber 31; the thickness of the wall at the bottom of the detonator 7 may increase on a curve from its central axis to a point close to its largest diameter, either on the inside or on the outside of the detonator, in order to avoid the effects referred to as flat or hollow charge in the case of an accidental explosion of this latter.

The percussion device is intended not to operate except upon impact; indeed, if, during the course of handling, or by accident prior to firing of the shot, the cap 11 is crushed in such a way that the body 21 is forced completely in until it touches the abutment 32, that is to say after having sheared through the mat 23, the point 33 of the plunger 10 can nevertheless not reach the active material 34 of the detonator 7, the stroke not being adequate. In order that there may be percussion, it is essential for the plunger 10 to shear through the mat 24 holding it inside the body 21; this shearing occurs when, after the body 21 has been forced into its housing 22, consecutively upon impact of the projectile against the objective reached, this body 21, by inertia, is projected forwards once again; at this moment, the plunger 10, free within the body 21, cannot assume the same speed as this latter and by inertia shears through the mat 24 (relative displacement). Moreover, the percussion device is provided with a steel plate 35 intended to prevent deformation of the housing of the plunger 10 in the body 21 at the moment of impact.

In the form of embodiment shown in FIG. 2, the envelope containing the explosive relay is provided with an extension 36 on the inside of the spring **30*a*, and compressing this latter, in a retractive position until it abuts on a composite shock absorption disc 37 disposed in the bottom of the sheath 29 and formed by two superimposed discs, a hard metallic disc coming in contact with the lower part of the extension 36, and a soft and elastic disc in contact with the bottom of the sheath. The disc 37 rigid with the projectile may be of conical shape and be intended to serve as a kind of clutch for the bottom end of the extension 36, in order to entrain this latter, and thus the relay 3*a*, rotating simultaneously with rotation of the projectile; the sheath 29 is crimped in the same way as in the case of the form of embodiment shown in FIG. 1, in the central body 38. In the alternative embodiment shown in FIG. 2' the sheath 29*a* is screwed partially within the central body 38*a*; in another form of embodiment (not shown) the sheath 29** is simply suspended by an upper collar.

The occluding means **13*a* of the form of embodiment illustrated in FIG. 2 is locked above the relay 3*a*, maintaining this latter in the retracted position, by means of dogs 39 mounted at right-angles to the central axis of the projectile and pushed towards the centre by springs 40. Sealing tightness of the device is provided by an O-ring 41**.

Furthermore, in order to avoid any risk of this occluding means becoming released due to lateral shocks, it is preferable to provide at least two dogs 39 and more particularly three or four dogs 39 which are disposed symmetrically on the circumference of the occluding means, that is to say with angles of respectively 120° and 90° between each dog.

The percussion device ensuring safety against dropping or slow crushing, illustrated in the form of embodiment shown in FIG. 2, comprises a body 42 containing a primer 43 mounted to slide therein, and a plunger **10*a* screwed on the upper part of this body 42, and the point 33*a* of which is situated close to the primer 43 but is nevertheless prevented from detonating this latter by an appropriate spring 44**.

In the case of slow crushing of the cap 11, the body 42 becomes depressed into its cavity 45, shearing the mat 46, this latter being provided solely to resist the inertia of the body 42 when the shot is fired, but without causing percussion of the primer 43, the rate of indentation not being sufficient for the force of inertia to overcome the strength of the spring 44. Moreover, the lugs 47 on the mat 46 are intended to deaden the accidental indentation of the body 42.

When the shot is fired, as soon as the projectile has started to rotate at a sufficient speed, the dogs 39 move apart outwardly under the action of centrifugal force, compressing their springs 40. The occluding means **13*a* and the relay 3*a* are then no longer retained in their initial position except by the inertia due to acceleration; when this acceleration has ceased, that is to say at the outlet from the barrel, the relay 3*a*, under the action of the spring 30*a*, pushes the occluding means 13*a* towards the front of the fuse; as soon as this occluding means 13***a* emerged from its initial housing, it moves aside and outwards under the effect of centrifugal force, until it is housed in the chamber 48. The relay 3*a* can then be brought into the armed position in contact with the detonator 7 or in the immediate proximity thereof. In this form of embodiment, the end of the detonator 7*a* which is directed towards the relay 3*a* does not project into the chamber 48 but is level with the upper wall thereof.

At the moment of impact, under the effect of deformation of the cap 11, the plate 12 pushes the body 42 back into its housing 45 after shearing of the mat 46, and the almost instantaneous passage to zero speed produces a relative movement which tends to project the plunger 10*a* and the primer 43 one against the other, compressing the spring 44, and thus triggering firing of the detonator 7*a* via the primer 43 and the sensitive material 34 in the detonator. The projectile according to the form of embodiment shown in FIG. 3 functions in the same way as that shown in FIG. 2 but is distinguished therefrom by the following few details of its fitment.

The explosive relay 3*b* is provided with an upper shoulder 49 and has no extensions such as the extensions 36 in FIG. 2, towards the bottom of the recess in the explosive charge 2; this shoulder 49 abuts on a shoulder 50 on the central body 38*b* and is intended to position the relay 3*b* and to prevent it from too strongly compressing the spring 30*b* upon the marked acceleration when the shot is fired, and is also intended to move this relay 3*b* with a rotary motion simultaneously with the gyration of the projectile.

The occluding means 13 having been released as previously, is brought into the chamber 51, larger than the chamber 48 in the form of embodiment shown in FIG. 2, under the effect of centrifugal force, into the position as shown in FIG. 3' in order to release the explosive relay 3*b* and allow this latter to assume its armed position as previously, under the action of the spring 30*b*.

The locking device, in the form of embodiment shown in FIG. 4, takes the form of a rotary drum occluding means incorporated between the relay 3*c* and the detonator 7. This occluding means therefore comprises a cylinder 52 in which there is a cylindrical hole 53, the diameter of which is slightly greater than the diameter of the relay 3*c*. The axis of the cylindrical hole 53 is at right-angles to the axis of the cylinder 52 or shell and in its non-armed position as shown in FIG. 4, the axis of the cylindrical hole is moreover disposed at right-angles to the axis of the projectile in order to prevent movement of the relay 3*c* in the direction of the detonator (retracted and locked position). Arming can occur only after the cylinder 52 has rotated through 90°, so that the hole 53 is disposed in the extension of the explosive relay 3*c*. However, only the force of acceleration caused by the firing of the shot can result in the cylinder 52 being unlocked from its initial and unarmed position.

When the shot is fired, the annular ring 54, under the effect of inertia due to acceleration, compresses the spring 55 as far as the abutment 56, thus releasing the balls 57 which are ejected by centrifugal force into the chamber 58. When the effect of the acceleration has ceased, the spring 55 and the inertia due to the deceleration push the annular ring 54 in such a way as to release from the groove 59 which extends along an inner generatrix of ring 54, the nipple 60 rigid with the cylinder 52. The nipple 60 is released in the cylindrical space 61 at which the groove 59 terminates. The cylinder 52 is then unlocked and can thus rotate through 90° under the action of the spring 62, the rotary travel of the cylinder 52 being limited by the abutment 63 so that the hole 53, then in the extension of the relay 3*c*, allows this latter to pass through it and this, pushed by the spring 30, moves into the advanced armed position in contact with the detonator 7 or in the immediate proximity thereof.

After unlocking, rotation of the cylinder 52 may be moreover retarded in order to produce a delay in arming.

FIG. 4' shows a detail of the locking device according to FIG. 4 in section on a plane perpendicular to the section as shown in FIG. 4. This FIG. 4' shows the movement from the lower end of the groove 59 of the ring 54, from a position IV to an advanced position IV', whereby the nipple 60 has become freed from the groove 59, so allowing the cylinder 52 to rotate until such time as the housing of the nipple is at position 60'.

In the form of embodiment illustrated in FIG. 5, the device for locking the explosive relay comprises an occluding means 13*d* in the form of a disc, in the edge of which there is an annular groove 64 intended to receive an elastic ring 65, this latter abutting the element 66 locking the occluding disc 13*d* which thus screens the relay 3.

When the shot is fired and under the effect of inertia due to acceleration, the elastic ring 65 slides towards the back of the projectile in order to be brought into its housing 75, thus unlocking the occluding means 13*d* which is pushed forwards by the relay 3 under the effect of the spring which it compressed in the retracted position and, after having emerged from its housing in the body 66, it is ejected laterally into the chamber 78 under the effect of centrifugal force, allowing passage for the relay 3*d* which will thus move into the advanced armed position.

The form of embodiment shown in FIG. 6 has a device for locking the explosive relay which is identical to that shown in FIG. 2 and a double-safe percussion device, the detail of which is illustrated in FIG. 6''. The plunger 10*e* is mounted on the upper part of a body 83 via a skirt 84. The body 83 contains in an axial recess a supplementary primer 43*e* which is rigidly disposed beneath the tip 33*e* of the plunger 10*e*. Moreover, this body 83 is mounted to slide in a body 85 and locked within this latter by an elastic ring 86 which counteracts a spring 87. In the case of premature slow crushing of the cap 11, the plate 12 would abut against the edge 88 of the body 85 without touching the plunger 10. In the event of the plunger having been in the armed position, that is to say above this edge 88, and in the event of a slow crushing, the body 83 and the plunger 10*e* would return to their housing in the body 85, compressing the spring 87 without triggering the primer 43*e*, the skirt 84 being unable to be deformed by such a slow crushing.

When the shot is fired, the force of inertia due to acceleration causes the elastic ring 86 to emerge from its housing provided in the body 83 and it takes up a position in the annular space 89, releasing the body 83. When the force of deceleration is felt on the projectile, this body 83, moreover under the effect of the spring 87, slides and emerges towards the front of the projectile in its housing and until such time as it is arrested by the abutment 90. At this moment, the head of the plunger 10*e* is clear of the body 85 and is in the armed position, in proximity of the plate 12, as shown in FIG. 6'.

At the moment of impact, even under quite considerable force, the plunger 10*e* is forced in by the plate 12, deforming the thin skirt 84 which was keeping it away from the primer 43; the deformation of this skirt 84 therefore produces percussion of this primer 43*e* by the tip 33 of the plunger 10*e*.

FIG. 7 shows another alternative embodiment of safety percussion device. A ring 91 is pushed and held in the locking position by the spring 92 against the abutment 93; moreover, it prevents the balls 94 emerging from their housing, these balls projecting on the inside of the housing 95 of the body 96, entering an annular groove 97 provided in the plunger 10*e*, the effect of which is to lock this latter. Moreover, the strength of the mat 98 is calculated so that it opposes the inertia of the plunger and maintains it in position when it is no longer locked after the shot has been fired, in order to increase safety.

When the shot has been fired, by inertia, the ring 91 slides on the body 96 compressing the spring 92. It remains held in this position by the restraining effect of a thin conical skirt 99 which it has in its lower part and which becomes deformed at the end of the stroke, upon contact with the chamfer 100, turning it back towards the centre. This crimping may be facilitated by the fact that the skirt is split according to a certain number of generatrices in order to constitute an equal number of lugs and retain the ring 91 by the shoulder 101. Since the balls 94 are freed, they emerge from the housing under the action of centrifugal force, so freeing the plunger 10*f* which is then no longer held in its bore except by the abutment 93 at the front and the mat 98 at the rear; this mat 98 will be sheared at the moment of impact causing a forcing-in of the plunger pushed by the plate 12 and causing it to penetrate the active material 34 of the detonator 7. FIG. 7' which is a section on the line VII—VII' of FIG. 7 shows the disposition of the balls 94 which lock the plunger 10*f* in the ring 96.

FIG. 8 shows a compression percussion device without arming and without a safeguard against dropping. The plunger 10*g* is held at a distance from the active material 34 of the detonator 7 by a mat 102. This is sufficiently strong to withstand the inertia due to acceleration when the shot is fired and emanating from the plunger 10*g* and a pusher ball 103 which is held against moving forwards by an element 104. At the moment of impact, the mat 102 is sheared allowing percussion of the active material 34 of the detonator 7 by the tip 33*g* of the plunger 10*g*, this latter being pushed by the plate 12 via the ball 103.

FIG. 9 shows a particular locking device in which the occluding plate 13*h* and plate for locking the relays 3*h* takes the form of a clack mounted on a drum 105 adapted to pivot about a lateral axis 106. In its position of rest, the clack 13*h* prevents the relay 3*h* from moving forwards into the armed position and it is maintained in this position by locking means not shown and which act on the free end of the clack; when the shot is fired, the inertia due to acceleration and/or centrifugal force act on the locking means to free the clack 13*h*; under the action of the relay 3*h*, and pushed by the spring to whose action it is subject, and under the action of a spring (not shown) provided on the drum 105, the clack 13*h* moves according to the arrow IX into the position 13*h'*, so allowing passage for the relay 3*h* which can then move into the advanced armed position.

FIG. 10 shows another alternative form of percussion device in which the plunger 10*i* is mounted on the assembly 107 which is capable of sliding in the body 108. Retention of the plunger 10*i* in the direction of percussion and safety against being dropped, are provided by the dogs 109 which are subject to the action of springs 110. This device which incorporates retention by the dogs 109 functions in a manner which is quite similar to that of the locking device of the occluding means 13 and relay 3 by virtue of the dogs 39 according to FIGS. 2, 3 and 6. Locking of the plunger 10*i* at the level of its tip 33*i* in the case of a crushing of the head of the projectile is thus assured. Retention of the plunger 10*i* and of its assembly 107 in the direction opposite to that of percussion is ensured by the tip 111. This tip 111 acts in a complementary fashion and adds its elastic resistance to the action of the dogs 109 ensuring safety if the projectile is dropped. Indeed, when the dogs 109 are moved apart by the action of centrifugal force and so release the plunger 10*i*, this latter is however still maintained in the unarmed position by the tip 111 which may undergo a slight deformation which does not exceed its elasticity limit. The difference in dimensions between the bore 108' in the body 108 and the diameter 107' of the assembly 107 allows optimum operation upon impact, the cone 111 of the tip being capable of easy deformation. Identation is thus ensured even in the case of the head being flattened and widening out on impact. Finally, the annular space 112 constitutes a gas expansion chamber in the case of inopportune operation of the detonator tending to prevent opening or deformation of the body of the fuse and of the detonator.

Finally, FIGS. 11 and 12 show a form of embodiment of the device for locking the retention means in the case where the projectile is an explosive hand grenade. This latter comprises a main body 113 containing particularly an explosive charge 2*j*, and a movable relay 3*j* in a crimped sheath 29*j*, and a firing cap with a detonator as the front part 114 of the grenade.

Between the main body 113 and the firing cap 114 there is a device 6*j* for locking the movable relay 3*j* which in this form of embodiment takes the form of a rotary drum occluding means incorporated between the relay 3*j* and detonator 7*j* of the firing device. This occluding means has a cylinder or shell 115 in which there is a cylindrical hole 116 the diameter of which is slightly greater than the diameter of the relay 3*j*. The axis of the cylinder hole 116 is perpendicular to the axis of the cylinder or shell 115 and in its unarmed safe position, as shown in FIG. 11, the axis of the cylinder hole 116 is moreover disposed at right-angles to the axis of the projectile in order to prevent the relay 3*j* moving in the direction of the detonator 7*j* (retracted and locked position). Arming can occur only after the cylinder 115 has been rotated through 90°, so that the hole 116 is disposed in the extension of the relay 3*j* as shown in the FIG. 12 (forward and armed position). The cylinder or shell 115 according to this form of embodiment moreover constitutes the pivoting axis of a lever 117 (the spoon of the grenade) disposed on the outside of the projectile. This lever 117 is intended to be moved under the action of a spring (not shown) according to the direction of the arrow XI (see FIG. 11), from the locked position (cylinder 115 occluding passage for the relay 3*j*)in FIG. 11, to that in FIG. 12

(armed position with the passage hole 116 in the extension of the relay 3*j*).

The locking device also comprises a dog 118 mounted at right-angles to the main axis of the projectile and pushed towards the centre by a spring 119. This dog 118 is intended to co-operate with a notch 120 provided in the cylinder 115 in order to lock this latter in the so-called armed position in which the passage hole 116 is in the extension of the relay 3*j*. This arrangement is needed in order to prevent the cylinder returning to its initial position in which it occludes the passage, during the trajectory of the grenade.

During storage and before the grenade is launched, the lever 117 is locked in its position shown in FIG. 11, by means of a pin 121. Releasing is performed by pulling the ring on the pin 122, but the lever 117 may still be held manually in its initial position; finally, once this lever 117 is released, and as this normally occurs with explosive grenades, the latter is moved until it is in its position shown in FIG. 12 under the action of its spring (not shown); in this case, this latter position corresponds to the positioning of the cylinder 115 so that the passage hole 116 is in the extension of the relay 3*j* this latter is then locked in this position by the dog 118 co-operating with the notch 120. The relay 3*j*, under the action of a spring (not shown) to which it is subject in its sheath 29, and in the same way as in the form of embodiment shown in FIG. 4, for example, moves into the proximity of the detonator, into the armed position.

In a manner similar to the cylinder 52 in the form of embodiment shown in FIG. 4, the cylinder or shell 115 of the form of embodiment shown in FIGS. 11 and 12 may likewise be provided with brake means intended to produce a delay in arming.

With regard to priming the detonator, the conventional retardation means (pyrotechnic, mechanical, hydraulic, electrical etc.) may be provided in the fuse cap.

A device with a rotary drum occluding means, such as that described above, may likewise be applied to the case of grenades having handles, the lever or spoon of the hand grenade being replaced by another device designed to cause the occluding cylinder to rotate through 90° by a manipulation carried out from outside the projectile.

The essential character of this invention, such as has been described by the examples and forms of embodiment above, therefore resides in the original conception of a projectile comprising a nose fuse and a detonator outside of the charge, and more particularly its priming device. This latter is distinct from the known devices in the sense that it comprises an explosive relay with no sensitive material which is always disposed at least partially within the explosive charge and which under the effect of the shot being fired, moves from an unarmed retractive position in which it is remote from the detonator, into a forward armed position in contact with the detonator or in the immediate proximity thereof. A device makes it possible to lock the relay in the retractive position until the shot is fired, and constitutes moreover a physical barrier between the relay and the detonator; this is moved away, when the shot is fired, under the action of the inertia of acceleration and centrifugal force or by a manipulation directed from the outside of the projectile to clear the passage for movement of the relay towards the detonator.

This physical barrier or occluding means may take many and varied forms, some of which are described in the forms of embodiment which are given by way of example. The occluding may therefore in particular consist:

- of an independent compact lozenge in a single piece or in a plurality of parts and of symmetrical or asymmetrical form, this latter form consisting for example of a lateral groove over half the lozenge which serves as an unbalance to favour eccentricity during ejection into a lateral chamber; the lozenge may likewise have a central conical recess on the relay side, contact between the occluding lozenge and the relay being effected on a crown; finally, according to circumstances, several lozenges may be placed one above another.
- An independent lozenge comprising an outer jacket enclosing a filling of metallic powder or small balls.
- A rotary drum in which there is a cylindrical hole the axis of which is at right-angles to the axis of the cylinder which constitutes the drum, and the diameter of which is slightly greater than that of the movable relay.
- a clack, in which one end is fixed to a lateral axis about which it can rotate.
- a ball wedged between the movable relay and the detonator.

This fuse is also provided with a percussion device which has a safety feature for the detonator so that the explosive charge of the projectile may be fired by the intermediary of the relay and operating for example by compression on impact. However, any other firing device may be used to equip a projectile having a nose fuse, particularly a piezo-electrical device, or to equip an explosive grenade.

A priming device according to this invention, with a detonator outside of the charge, a movable explosive relay detonator outside of the charge, a movable explosive relay which can be locked and a protective occluding means ensures that the projectile has a very high degree of safety in use (safety against dropping) with an arming delay (muzzle safety); it is worth noting that the device used allows regulation of the delay at arming, a regulation which is needed for example in the case of certain light infantry weapons requiring rapid arming of the fuse for short-distance firing.

In addition, this invention offers the following advantages:

- Great flexibility of use since the device with a movable relay may be applied equally well to projectiles fired from tubes or guns and also to hand launched projectiles.
- A device for percussion due to compression on impact reinforcing handling safety and safety in using the projectile and allowing operation with considerable effects on the target sighted.
- General design of the explosive projectile as a whole is of very simple manufacture and assembly, allowing a vast number of combinations by changing the head fuse for example, and by virtue of the fact that it is absolutely fluid-tight, is light in weight and is of low prime cost.

Moreover, the nose of the explosive projectile may be made so that in the event of premature or inopportune explosion of the detonator outside of the charge, this latter does not open but withstands the effects of the explosion or at least suffers only a slight swelling, the deformation of which does not go beyond the gauge of the main body. In effect, this makes it possible to avoid damaging the barrel of the weapon if the detonator operates within the weapon, and also prevents damage to loaders or other ammunition situated in the vicinity.

I claim:

1. Explosive projectile comprising an explosive charge and a device for firing a detonator outside of the charge, in which the explosive charge comprises a recess, the projectile comprises a device for priming this explosive charge comprising an explosive relay housed at all times at least partially in the recess in the explosive charge and mounted to slide therein between a retracted safety positon in the explosive charge for which the relay is kept remote from the detonator and a forward armed position in which this relay is situated in the immediate proximity of the detonator or is in contact therewith, while being partially engaged in the explosive mass, and a device for locking the explosive relay in its retracted safety position, characterised in that the device for locking the relay comprises an occluding device (13) placed in front of the front end of the relay (3) and means for locking this occluding means and maintaining the relay (3) in the unarmed position.

2. Projectile according to claim 1, characterised in that the recess made in the explosive charge is of cylindrical shape and is disposed axially, and in that the explosive relay (3) is also of cylindrical form.

3. Projectile according to claim 1, characterised in that the explosive relay (3) is mounted to slide within the sheath (29) and in that a spring (30) is disposed between the bottom of the sheath and the rear part of the relay.

4. Projectile according to claim 1, characterised in that the front end of the relay (3) is widened in cross-section to constitute a shoulder (49) for positioning and rotatingly driving the relay (3) within the sheath (29).

5. Projectile according to claim 1, characterised in that the occluding means is disposed between the relay (3) and the detonator (7) to form a barrier.

6. Projectile according to claim 1, characterised in that the locking device (13) is a clack mounted on a drum (105) pivoting about a lateral axis (106).

7. Projectile according to claim 1, characterised in that the means of locking the occluding device are balls (14) disposed in housings (15) provided in a fixed element (16) of the fuse and abutting the front part of the occluding device on the one hand and abutting a ring mounted to slide around the fixed element and on a spring (20) on the other hand.

8. Projectile according to claim 1, characterised in that the means of locking the lozenge consist of an elastic ring (65) placed in a circular groove (64) provided in the edge of the lozenge, and abutting a shoulder of a fixed element (66) of a fuse.

9. Projectile according to claim 1 characterised in that a plunger (10) comprises an annular groove (97) partially receiving balls (94) mounted in housings provided mounted in a fixed body (96) of in the projectile fuse and abutting a ring (91) sliding about the fixed body (96) and mounted on a spring (92).

10. Projectile according to claim 1, characterised in that a plunger (10) is mounted to slide within a fixed element of a nose fuse and in that its stroke is limited rearwardly by a mat (102) and forwardly by a ball-pusher (103) locked by a fixed element (104).

11. Projectile according to claim 1, characterised in that a percussion device comprises the primer (43) mounted between the tip (33) of a plunger (10) and sensitive material (34) of the detonator (7).

12. Projectile according to claim 1, characterised in that a primer (43) is mounted to slide within a body (42) mounted to slide in a fixed element of a nose fuse and abutting a mat (46) and in that a plunger (10) is mounted rigidly on the front part of the body (42) and against a spring (44) disposed just in front of the primer, to the action of which it is subject.

13. Projectile according to claim 1, characterised in that a plunger (10) of a percussion device is fixed on an assembly (107) mounted to slide in a fixed body (18) and in that the plunger (10) and its assembly (107) are locked towards the rear of the projectile by at least two dogs (109) mounted to slide and subject to the action of springs (110) within transverse housings provided in the fixed body (18) and radially with respect to the axis of the projectile and in that they are moreover maintained forwards by a tip (111) which is capable of undergoing elastic deformation.

14. Projectile according to claim 1, characterised in that the projectile, the relay (3), the locking device (13) and means of locking this latter constitute one assembly on which is screwed a fuse head containing a firing device.

15. Projectile according to claim 1, characterised by a housing in a fixed part of the projectile to receive said locking means, said housing being cylindrical.

16. Projectile according to claim 1, characterised in that a sheath (29) matches the inside shape of the recess provided in the explosive charge.

17. Projectile according to claim 16, characterised in that the sheath (29) is crimped on a fixed element midway between the explosive charge and the detonator situated in front of this explosive charge.

18. Projectile according to claim 1, characterised in that a sheath (29) is screwed to a fixed element of a fuse situated in front of the explosive charge.

19. Projectile according to claim 18 characterised in that the sheath (29) has an upper collar designed to hold it suspended in the housing provided in the explosive charge (2).

20. Projectile according to claim 1, characterised in that a plunger (10) is mounted to slide in a housing provided axially in a body (21) which is likewise mounted to a slide in a fixed element (8) in the projectile and in that the plunger and the sliding body are respectively locked towards the rear of the projectile by mats (24 and 23).

21. Projectile according to claim 20 characterised in that a primer (43) is mounted rigidly inside a body (83) sliding within a fixed element (85) of a nose fuse and on a spring (87) and in that a plunger (10) is mounted in front of this body (83) above the primer through a thin deformable skirt.

22. Projectile according to claim 1, characterised in that the relay (3) is provided with an extension (36) towards the rear, abutting in the retracted position against a composite shock-absorber disc (37) placed in the bottom of a sheath (29) and serving as a clutch to drive the relay (3) with a rotary movement simultaneously with the revolution of the projectile.

23. Projectile according to claim 22, characterised in that the composite shock-absorber disc (37) is formed by superposing a hard metal disc on a soft elastic disc, the metal disc being in contact with the bottom end of the extension (36) and the soft disc being in contact with the bottom of the sheath (29).

24. Projectile according to claim 22, characterised in that the side of the metallic disc of the composite shock-absorber disc (37) which comes in contact with the bottom end of the extension (36) is of conical shape to facilitate its functioning as a clutch means for rotary driving of the relay (3).

25. Projectile according to claim 1, characterised in that the occluding means (13) is a lozenge.

26. Projectile according to claim 25, characterised in that the lozenge is made in one piece.

27. Projectile according to claim 25, characterised in that the lozenge is of symmetrical form.

28. Projectile according to claim 25, characterised in that the lozenge comprises a central conical recess.

29. Projectile according to claim 1, characterized in that the detonator (7) is mounted axially and rigidly on the projectile and in that it has a sensitive material (34) in its front part.

30. Projectile according to claim 29, characterised in that the detonator (7) has at its rear free end a thickening of its back wall forming a peripheral inner or outer bead.

31. Projectile according to claim 29, characterised in that the detonator (7) projects on the inside of the chamber separating it from the relay (3).

32. Projectile according to claim 29, characterised in that the free end of the detonator (7) is level with respect to the front wall of the chamber separating it from the relay (3).

33. Projectile according to claim 1, characterised in that the locking device (13) is a cylinder (52, 115) the main axis of which is at right-angles to the axis of the projectile, and which is pierced with an orifice (53, 116) traversing it at right-angles to the axis of the cylinder and slightly larger in diameter than the diameter of the relay (3).

34. Projectile according to claim 33, characterised in that the cylinder (52) is mounted to rotate a spring (62) and in that it is locked in its position in which the orifice is at right-angles to the relay (3) by means of a nipple (60) co-operating with a groove (59) in an axially sliding element which is subject to the action of a spring and which is locked by a ball (57).

35. Projectile according to claim 33, characterised in that the cylinder (115) is locked in its position in which the orifice (116) is disposed in the extension of the relay (3) by means of a dog (118) co-operating with a notch (120) provided in the cylinder (115).

36. Projectile according to claim 33, characterised in that the cylinder (115) constitutes the pivoting axis of a lever (117) which can be operated from the outside of the projectile, and in that this lever is locked by a pin (121) for a position of the cylinder (115)such that the orifice (116) is at right-angles to the relay (3).

37. Projectile according to claim 33, characterised in that the locking device (13) comprises means for retarding the rotation of the cylinder (52, 115) in order to produce a delay in arming.

38. Projectile according to claim 1, characterised in that the means of locking the lozenge are constituted by at least two dogs (39) mounted to slide and subject to the action of springs (40), inside transverse housings provided in a fixed element of a nose fuse and radially with respect to the axis of the projectile.

39. Projectile according to claim 29, characterised in that the dogs (39) are at right-angles to the axis of the projectile.

40. Projectile according to claim 38, characterised in that the means of locking the lozenge are constituted by at least three dogs (39) disposed radially with respect to the axis of the projectile.

41. Projectile according to claim 40, characterised in that the locking means consists of four dogs.

* * * * *